United States Patent [19]

de Poncins

[11] 4,026,405

[45] May 31, 1977

[54] PROCESS AND APPARATUS FOR DETERMINING THE MAGNITUDE OF THE PAPER ADVANCE COMMANDED IN A PRINTING MACHINE

[75] Inventor: Gérard de Poncins, Neuilly, Seine, France

[73] Assignee: Compagnie Honeywell Bull (Societe Anonyme), Paris, France

[22] Filed: Apr. 28, 1975

[21] Appl. No.: 571,923

Related U.S. Application Data

[63] Continuation-in-part of Ser. No. 413,700, Nov. 7, 1973, abandoned.

[30] Foreign Application Priority Data

Nov. 9, 1972 France ..... 72.39746

[52] U.S. Cl. ..... 197/133 R; 197/127 R

[51] Int. Cl.[2] ..... B41J 15/00

[58] Field of Search ..... 197/19, 20, 114, 120, 197/121, 133, 127 R; 101/93.01

[56] References Cited

UNITED STATES PATENTS

| | | | |
|---|---|---|---|
| 3,094,261 | 6/1963 | Thompson | 197/133 X |
| 3,185,283 | 5/1965 | Spitsbergen et al. | 197/133 R |
| 3,326,348 | 6/1967 | Cralle et al. | 197/114 |
| 3,524,528 | 8/1970 | Peyton | 197/133 R |
| 3,557,929 | 1/1971 | Schaaf | 197/133 R |
| 3,658,163 | 4/1972 | Sniderman | 197/133 UX |

*Primary Examiner*—Ralph T. Rader

*Attorney, Agent, or Firm*—Diller, Brown, Ramik & Wight

[57] ABSTRACT

In printing data on paper sheets which are connected along lines of perforation, the paper advance relative to the printer is controlled to assure that the proper kind of data is printed in the appropriate area or areas of the sheet or sheets to which such kind of data has been assigned. Different levels of the sheet corresponding to these areas are identified by the number of spaces between such levels and the upper edge of the sheet and a control system is employed which monitors the position of the printing line with respect to the upper edge of the sheet and which controls the paper advance in accord with the levels of the areas.

7 Claims, 4 Drawing Figures

TO APPARATUS FOR DETERMINING THE MAGNITUDE OF THE PAPER ADVANCE

PROCESS AND APPARATUS FOR DETERMINING THE MAGNITUDE OF THE PAPER ADVANCE COMMANDED IN A PRINTING MACHINE

CROSS REFERENCE TO RELATED APPLICATION

This application is a continuation-in-part of copending U.S. application Ser. No. 413,700, filed Nov. 7, 1973 now abandoned.

BACKGROUND OF THE INVENTION

The present invention relates to a process and an apparatus for determining the magnitude of the jumps to be commanded in a printing machine, notably a printer used in data processing.

The printing base of a printer used in a data processing system generally is in the form of a sequence of paper sheets which may be detached by means of tearing transverse perforations defining an upper and lower edge for each sheet.

Driving these sheets in front of the printing device is commanded by "jump", each jump causing a "paper advance" evaluated in the number of spaces between lines, or, for short, "spaces".

When an analyst defines the page-setting of an office-equipment print, he indicates the levels at which the various data must be printed on the sheet of which this print is made. The programmer, who is charged with drawing up the sequence of printing, is sometimes unable to define the distance, or the number of spaces, separating two consecutive printing lines respectively assigned to two different kinds of data, on account of the fact that the number of data likely to be printed is not always constant.

If, for instance, a bill for accounts due is involved, the gaps separating the name from the address of the client, and the address from the first article object of the bill may be easily determined; on the other hand, the number of articles billed being variable, the distance from the last article billed to the amount or total of the bill, the location of such total being fixed, cannot be predetermined.

A number of solutions have been proposed for this problem.

One of them uses a "mechanical control band", or, a paper strip or tape; the length of the sheet on which the stopping levels assigned to the various kinds of data that may be printed is indicated by perforations, the positions of the perforations with respect to the upper edge of the strip or tape defining the distances separating said levels from the upper edge of a sheet, and the positions of the perforations between the lateral edges of said tape defining the kind of data to which said levels are assigned. The control or pilot tape is mounted on a mechanical base which is solidly connected with the paper drive mechanism; the tape moves in synchronism with the sheet; a read-out device comprising as many reading heads as there are positions or "channels" defined between the lateral tape edge allows detecting the perforations. The drive motor which causes the paper to advance is controlled when selecting the reading head associated with the channel for the kind of data to be printed. Paper motion continues till there is detection of a perforation in the channel under consideration. The above-described solution offers the disadvantage of forcing the user to replace the control band each time he changes from one kind of print to another.

A more elaborate solution uses a memory comprising as many positions as there are spaces in a sheet. Each memory position may store a channel number, so that one may identify each stopping level with a particular kind of data. A space counter coupled to the jump motor continuously indicates the distance between the printing line of the printer and the upper edge of the sheet holding said printing line. Simultaneously with the jump motor command, data is provided, identifying the channel number assigned to the kind of data to be printed. The memory is swept from the position corresponding to the space counter contents; this sweep occurs in synchronism with the paper motion; it allows reading and comparing the contents of each memory position with the channel number obtained from the command. The jump will stop when there is equality. The memory contains an "end of sheet" code allowing reset to zero of the space counter.

The latter solution suffers from a number of drawbacks, among which is the requirement of a fairly large-capacity memory; further it does not allow for the assigning of identical stopping levels to different channels.

BRIEF SUMMARY OF THE INVENTION

The present invention relates to a process and apparatus for determining magnitude of the jumps to be commanded in a printer, where this process and apparatus offer the following advantages:

1. very high adaptability;
2. use of a restricted capacity memory; and
3. feasibility of assigning identical levels to different channels.

The process of the invention for determining the jump magnitudes to be commanded in the printer, of which the printing support consists of a series of sheets bounded by an upper and lower edge, is mainly characterized as follows:

1. Determining the positions, expressed by a whole number of spaces, with regard to the top edge of the sheet, on one hand, for the different stopping levels assigned to each kind of data that may be printed, and on the other hand, for the printing line at which the printer stopped;

2. Comparing in chronological order, with regard to the top edge of the sheet, the different positions of the stopping levels with the position of the printing line at which the printer stopped, this comparison being followed by one of the following operations:

a. As soon as the comparison discloses a stopping level further from the top edge than the printing line at which the printer stopped, a jump is commanded and this jump corresponds to the difference, expressed by a whole number of spaces, between the position of the stopping level, on the one hand, and the position of the line at which the printer stopped, on the other, this jump being effected in the considered sheet; or b. If the comparison does not disclose any stopping level lower than the line at which the printer stopped, a jump is commanded and this jump corresponds to the difference expressed by a whole number of spaces, between the position of the first stopping level added to the number of spaces in the height of the sheet, on the one hand, and the position of the line at which the printer stopped, on the other, this jump being effected on the sheet following said considered sheet.

The apparatus for implementing the process of the invention is associated with a data processing unit, and mainly comprises:

1. A storage unit comprising a read-write reference memory unit connected to the data processing unit, this memory including $n+1$ registers sequentially selected, where $n$ is at least equal to $c + a(1) + a(2) \ldots a(c)$, $c$ being the number of the types of data that may be printed and $a(1)$, $a(2) \ldots a(c)$ being the numbers of stopping levels that may be assigned to types of data 1,2 . . . $c$.

The registers for each type of data are at least as follows:

a. a first register for storing a reference identifying the type of data;

b. a number $a$ of registers for storing, in increasing order in the sense of the sequential selection of the registers, the number of spaces between each of the stopping levels assigned to a given type of data and the top edge of the sheet; and A last register may be provided for each type of data for storing the end-of-channel code which designates the last register associated with the given type of data.

An additional register may be provided to store the number of spaces corresponding to sheet height.

2. A jump analysis circuit connected to the data processing unit and to the read-write reference memory unit, controlled by the data processing unit.

3. A pulse counter connected to the paper advance mechanism of the printer, the contents of said pulse counter expressing the distance, in number of spaces, between the printing line at which the printer has stopped and the upper edge of the sheet.

4. A comparator, the inputs of which are connected to the pulse counter and to the sequentially selectable registers of the read-write memory, mentioned in paragraph 1($b$) above.

Other characteristics and advantages of the invention will be made clear in the description below, which is of an illustrative and non-restricting nature, and in concert with which the following figures are attached.

BRIEF DESCRIPTION OF THE DRAWING FIGURES

DETAILED DESCRIPTION OF THE INVENTION

Figure 1:
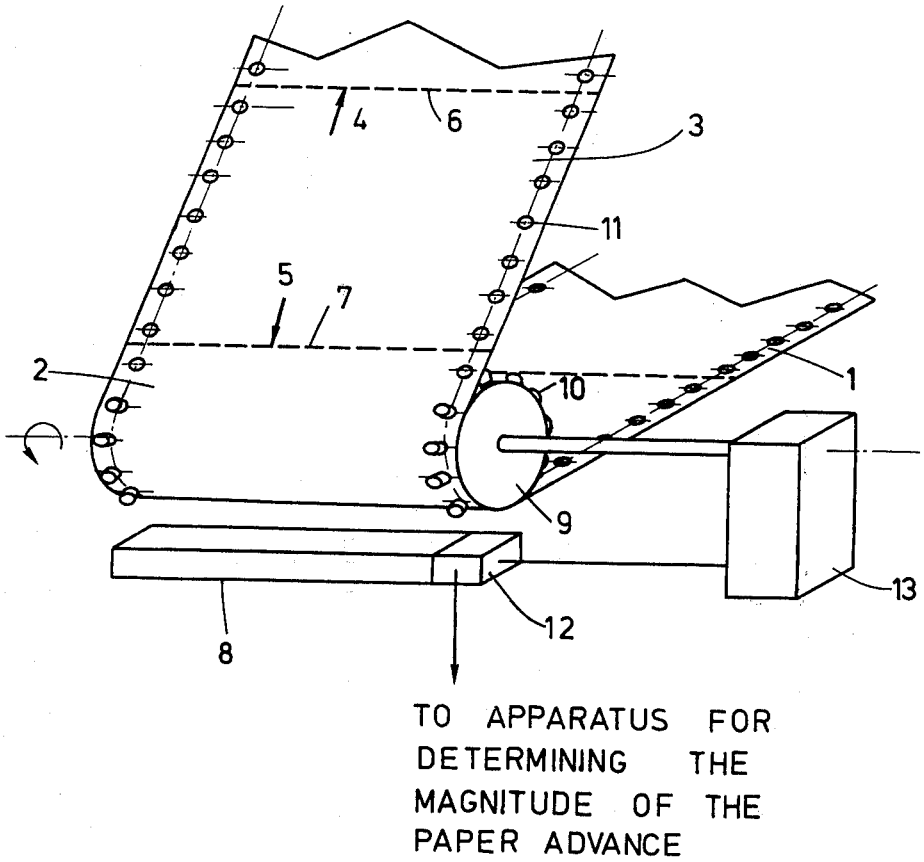
FIG. 1 is a general view of one printer including a sequence of paper sheets which may be detached.

FIG. 1 shows a general view of a printer 21 including a sequence of paper sheets 1, 2 and 3, which may be detached. Each sheet, and specifically sheet 3, comprises a top edge 4 and bottom edge 5, limited by transverse perforations 6 and 7, respectively. The paper is driven in front of a printing device 8 by means of paper advance mechanism 13 which actuates driving roller 9, comprising cogs 10, which enter perforations 11. The printing device 8 comprises also a pulse generator 12 connected to paper advance mechanism 13 so as to be capable of emitting one type of pulse at each jump of a space as commanded in the printer, and a second type of pulse when a line of transverse perforations passes the printing device 8, indicating a new sheet. The pulses from pulse generator 12 can be used to keep track of the distance in number of spaces, between the printing line at which the printer stopped and the top edge of the sheet.

Figure 2:
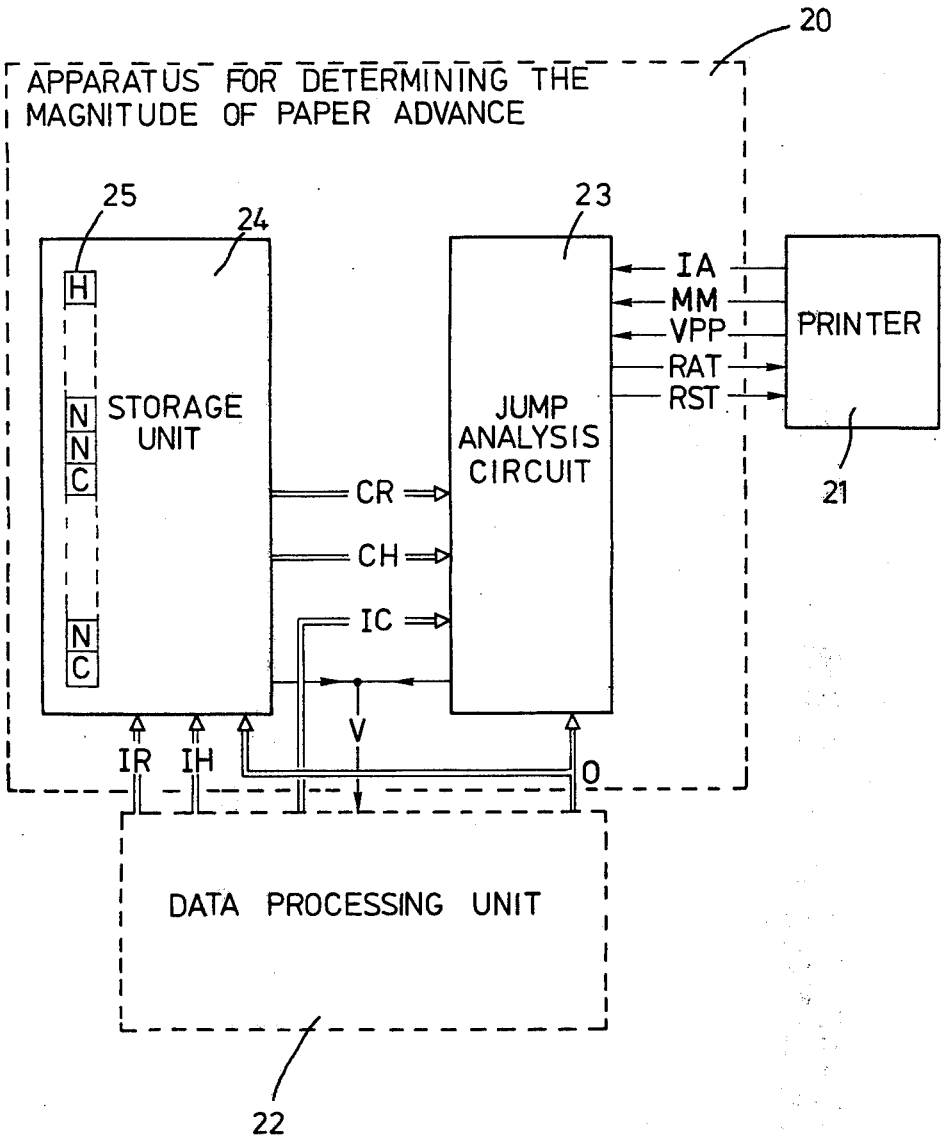
FIG. 2 is a block-diagram of the main circuits of the apparatus implementing the process of the invention and associated with a printer and a data processing unit.

FIG. 2 is a block diagram including the apparatus 20 of the invention, to which is connected a printer 21 and a data processing unit 22. This data processing unit is, for example, a central processing unit Honeywell 6000. As the block diagram shows, the printer 21 applies three types of data to a jump analysis circuit 23 which is in turn connected to the storage unit 24. The three types of data applied to the jump analysis circuit 23 are as follows:

a. data IA—pulses applied at each "jump" of a space as commanded in the printer;

b. data MM—indicating the start of the printer; and c. data VPP—pulse emitted when a transverse line of perforations in the printing support or base passes at the level of the printing device of the printer (As may be remembered, this support is in the form of a sequence of sheets separated from one another by the preforated transverse lines which form a boundary at the upper and lower edges of a sheet under consideration).

The data processing unit 22, in addition to supplying commands O to both the storage unit 24 and the jump analysis circuit 23, applies two types of data to the storage unit 24 and one type of data to the jump analysis circuit 23, as follows:

a. data IR—a series of three data which indicate, for each "channel", the identity of the channel (thus identifying the type of information that may be printed), the stopping levels (number of spaces that were counted from the upper edge of a sheet for each level associated with the type of information), and an end-of-channel code;

b. data IH—defining the height of a sheet in number of spaces; and c. data IC—identifying, during operation, the channel at which a stopping level must be sought for printing the data type identified by this channel (It may be, for instance, the channel corresponding to "articles" of a bill, requiring printing several articles that were sold, hence requiring several stopping levels).

The data processing unit 22 transmits a series of commands O to the apparatus 20. Some of the commands O are for comparison and, depending on the results from the latter, the apparatus will provide data V which, when transmitted to the data processing unit 22, will or will not alter the sequence of commands.

The apparatus 20 is made up of jump analysis circuit 23 and storage unit 24. The storage unit 24 comprises a reference memory 25 for storing the IR and IH data as a function of the commands O emitted by the data processing unit 22. In the reference memory 25, RC1, RC2 and RCn represent symbolically the channel identity for channels 1, 2 and $n$, as contained in registers R1, R4 and R$n$-2, respectively; RA10, RA20, RA21 and RA$n$ represent the stopping levels for channels 1, 2 and $n$, as contained in registers R2, R5, R6 and R$n$-1, respectively; and R ▶ represents an end-of-channel code as contained in registers R3, R7 and R$n$. The height of the sheet, H, is represented in register RH. The jump analysis circuit 23 processes the data stored in the reference memory 25 when data IC has been emitted as a function of the commands O from the data processing unit 22.

Figure 3:
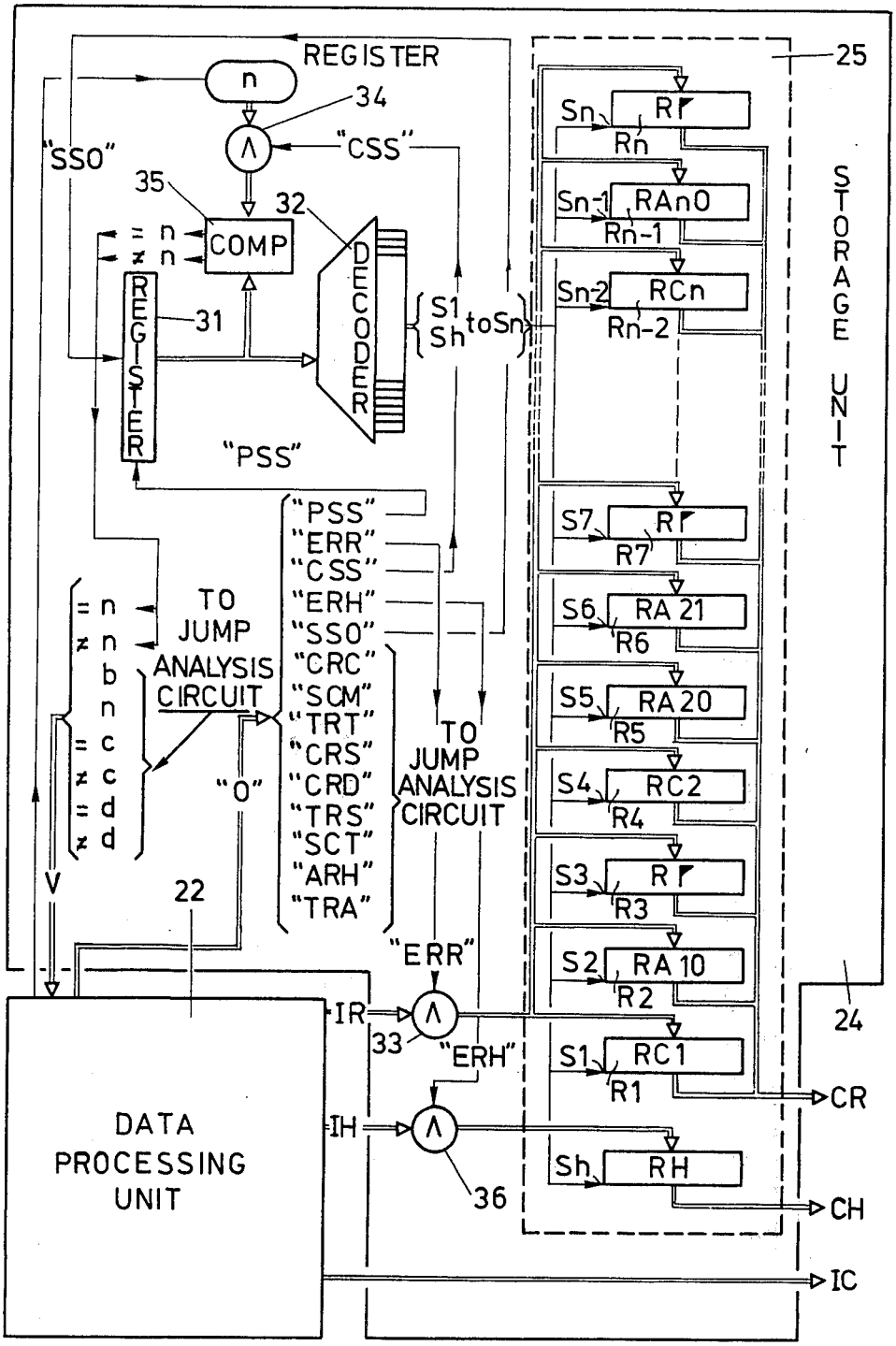
FIG. 3 is essentially the circuits of block 25 of FIG. 2, which is part of said apparatus.

FIG. 3, shows the reference memory 25 and its associated circuitry, and, in diagrammatic form, the data processing unit 22 and the data and commands emitted by that unit.

The reference memory 25 is made up of *n* registers R1 . . . R*n* plus one register RH. Its auxiliary circuits essentially are a selection circuit consisting of a register 31 coupled with a decoder 32. Register 31 is reset to zero by the SSO command emitted from the data processing unit 22 and advances from position 1 to the position *n*+1 by command PSS. Decoder 32 thereby applies the selection signals *s*1 . . . *sn*, then sh to registers R1, R2 . . . R*n*, RH, (*sh* is provided when the register is at the *n*+1 position). Register 31 also is connected to one of the inputs of a comparator 35, the other input of which is connected to receive data equal in magnitude to *n* by the intermediary of coincidence gate 34 confirmed by the CSS command, so that said comparator provides the signal =*n* if register 31 is at the *n* position and a signal ≠ *n* if said register is at any other position. This allows the selection of one register of the memory 25, by means of data processing unit 22.

When the register of the reference memory is selected, commands ERR (or ERH for register RH) are provided by data processing unit 22. These orders allow obtainment of the contents CR and CH of the registers R1 and RH, respectively, of the reference memory 25.

The *n* registers R1 . . . R*n* are assigned to the storing of coded data so as to permit, during processing, the analysis of the number of spaces between the printing line at which the printer stopped and one of the stopping levels assigned to the type of data or "channel", the identity of which is given by data IC. A total of *a* + *2* registers (where *a*, as previously defined) is assigned to a channel in memory 25; the first register permits the storing of channel identity; the last register permits the storing of an "end of channel" code; the intermediate registers (*a* may be equal to or larger than unity) are assigned to storing the number of spaces between each level assigned to the channel under consideration and the upper edge of the sheet; if *a* is larger than unity, storage will be performed in increasing order of the number of spaces.

As regards register RH, it is assigned to the storing of the number of spaces between the upper and lower edges of a sheet.

The sequence of the commands emitted by the data processing unit 22 begins with a command for progression by the sequential selection register 31, that is, with command PSS; register 31 passes to position 1 and selects register R1 by means of decoder 32 which provides the signals S1. The next command ERR conditions coincident gate 33 for transmitting the first data IR supplied by the data processing unit 22. This first data is a channel identity code, RC1, and is stored in register R1. The command CSS conditions the coincident gate 34 for comparing the contents of register 31 with permanent data corresponding to the number *n* of registers of the reference memory 25; at this stage of data processing, register 31 is at position 1, comparator 35 supplies a signal of non-identity ≠ *n*, and the sequence loops itself at the first command for progression, PSS, from register 31; the latter passes to position 2 and selects register R2 by providing signal S2.

In the example shown, the second datum IR supplied by the data processing unit 22 relates to the number of spaces corresponding to the stopping level for the channel in question (channel 1) and is stored in register R2. In a similar manner, the third datum IR, a flag code R ▶, is supplied by data processing unit 22 and stored in register R3, comparator 35 having again emitted the non-identity signal ≠ *n* and register 31 having passed to position 3.

Storage goes on in similar manner for all channels until comparator 35 supplies the identity signal = *n*. The sequence terminates by means of three commands:

1. a progression command PSS from data processing unit 22 which causes register 31 to pass to the *sh* position selecting register RH;
2. a transmission command ERH which conditions coincident gate 36 so that, when data IH is supplied by the central processing unit 22, it is passed to register RH; and
3. a command SSO that registers 31 be reset to zero.

It will be observed that in the example shown, two stopping levels are assigned to the channel served by registers R4–R7, the identity being stored in register R4; for this and every case, the stopping levels are stored in increasing order of the number of spaces corresponding to them.

Figure 4:
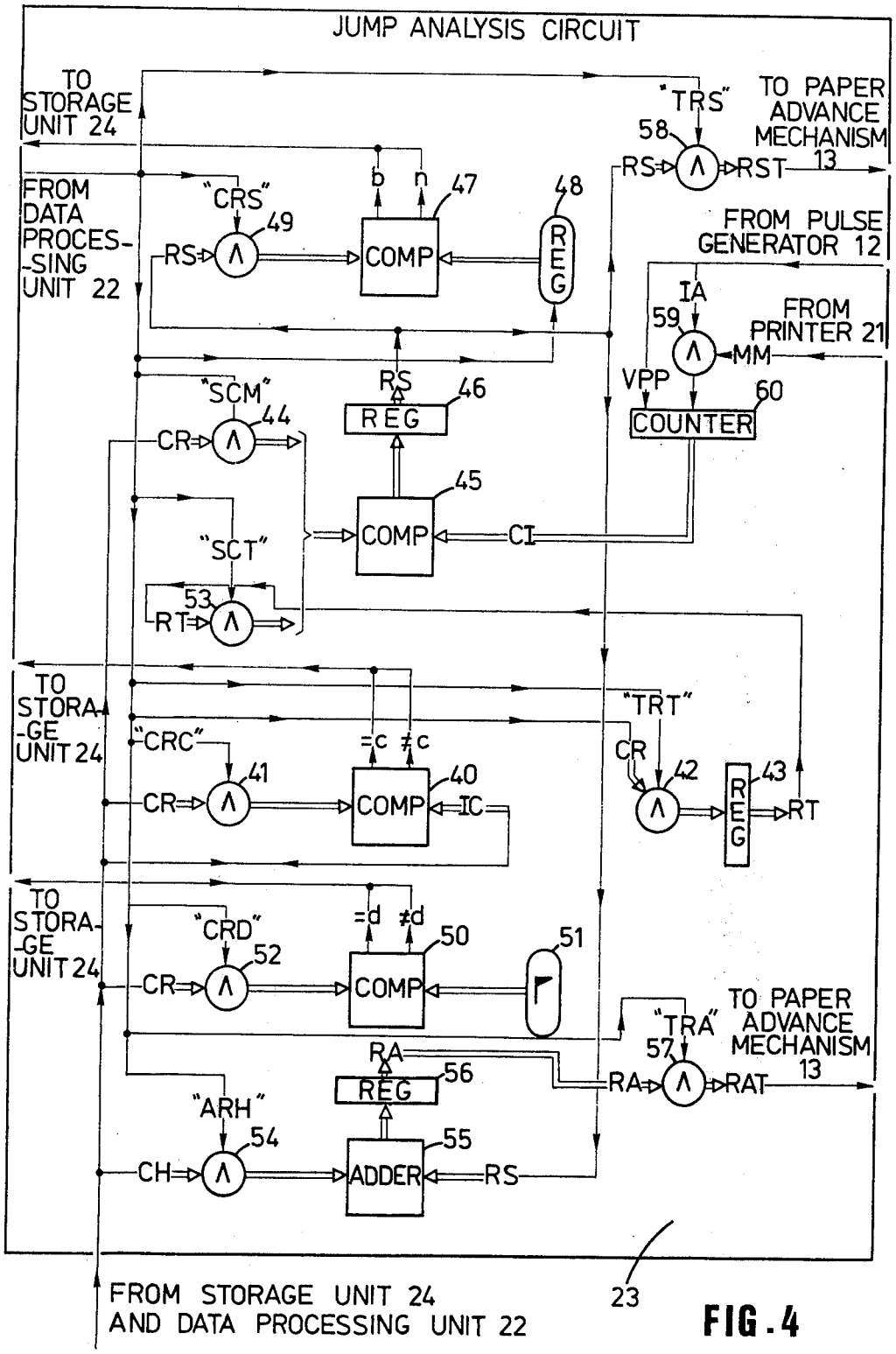
FIG. 4 is essentially the circuits of block 24 of FIG. 2, which is part of said apparatus.

The jump analysis circuit 23 is shown in FIG. 4 in connection with the reference memory from which it receives data CR (register contents) and CH (height of sheet); in connection with central processing unit from which it receives data IC (channel identity of channel where a stopping level is to be sought) and the commands in the form of corroborations (e.g. CRS, TRS) for the coincidence gates (e.g. 49, 58); and in connection with the printer from which it receives data MM (permanent signal reflecting the ON state of the printer) and data IA (pulse signal supplied by pulse generator 12 each time a space is commanded in the printer) and data VPP (pulse signal supplied by pulse generator 12 each time the printer's printing device passes the level of a transverse, perforated line bounding two consecutive sheets). It will be noted that pulses VPP and IA are used by counter 60 so that, as a result, data CI provided by counter 60 represents, at any time, the number of spaces between the printing line at which the printer stopped and the upper edge of the sheet containing this printing line.

The circuit of FIG. 4 and its operation will be described for computing the magnitude of the jump to be commanded as a function of data CI and IC.

Reference memory 25 having been loaded as described above, the apparatus will be ready to process the data stored in the memory. This processing will permit the apparatus to control the paper advance mechanism of the printer and to define this control in such manner that, at the end of the command, the printing device of the printer will be located in front of a printing line corresponding to a stopping level assigned to a type of information or "channel", the code of which is provided by the data processing unit 22. This code is symbolized in FIG. 3 by the transmission of datum (IC).

When datum (IC) is present, the data processing unit 22 will supply the command sequence shown in FIG. 3.

The first part of the command sequence provided by the data processing unit 22 starts the sequential selection of registers R1 to R*n* of memory 25 (command PSS), followed by the comparison of the contents of each of said registers with datum (IC) until equality between one of those contents and said datum is achieved. The jump analysis circuit shown in FIG. 4 comprises a comparator 40, one input of which receives datum (IC), the second input of which receives datum (CR) (the contents of the selected register) by the intermediary of a coincidence gate 41 corroborated by the CRC command. If comparator 40 emits the non-identity signal $\neq c$, the search will continue; on the other hand, if it emits the signal of identity $= c$, the command sequence turns to testing the ensuing register, the contents of which, as stated before, expresses the corresponding number of spaces, either at the only stopping level assigned to the channel being considered, or at that stopping level which, among those assigned to the channel under consideration, is nearest the upper edge of the sheet. For example, assuming the search resulted in the selection of R1, the signal $= c$ from comparator 40 will be passed to data processing unit 22, which will issue the PSS command so as to cause progression of register 31, that register causing decoder 32 to issue signal *s*2 so as to select R2.

Therefore, the second part of the command sequence begins with the PSS command (progression of register 31 in FIG. 3), after which the following signals will be emitted:

1. command TRT, causing transmission of the contents (CR) of the selected register via coincident gate 42 to a temporary waiting register 43 (the usefulness of this command will become clear further below);

2. command SCM which conditions coincident gate 44, causing comparision of contents (CR) of the selected register with the contents (CI) of the counter 60 by means of subtraction (CR)-(CI) in comparator 45, the result of this subtraction being transmitted into register 46.

As already previously stated, datum (CI) is derived as follows: Signal MM, which indicates the start of the printer, conditions the coincident gate 59 so as to pass:

a. pulses VPP to the counter 60, each pulse representing passage of a line of perforations in the printing support or base at the level of the printing device of the printer, causing counter 60 to be reset to zero; and b. pulses IA to the counter 60, said pulses representing a "jump" of one space as commanded in the printer, thus causing counter 60 to increment by one.

If the result of subtraction (CR)-(CI) is positive, it is known that the printing line as indicated by (CI) is located between the top edge of the sheet and the stopping level expressed by contents (CR); on the other hand, if the result is negative, the printing line as indicated by (CI) is known to be below the stopping level, and it will be necessary either to seek another stopping level assigned to the channel under consideration, or else to command jumping to the next sheet if there is only one stopping level assigned to the channel.

A choice between the positive and negative result is made by means of the CRS command as follows: testing the result (RS) of the subtraction in order to determine whether the result is positive or negative; and making use of the comparator 47, one input of which receives from one register 48 a datum symbolizing a positive reference, and the second input of which receives datum (RS) by the intermediary of a coincidence gate 49 corroborated by the command CRS.

If the result is positive (signal *b*), the sequence by means of data processing unit 22, which issues the command TRS, will turn to transmitting the result (RST) to the printer via coincident gate 58. This command is followed by an SSO command for reset to zero of register 31, whereby the sequence is terminated.

On the other hand, if the signal is negative (signal *n*), the sequence continues so as to seek another stopping level by means of selection register progression command PSS, followed by command CRD. This command will enable comparator 50 via coincident gate 52 so that, if there is another stopping level assigned to the channel under consideration, comparator 50, which receives at one input the data of the "flag" code 51, and at the other input the contents of the selected register (CR), will supply the signal $\neq d$ to data processing unit 22. In these circumstances, the sequence will loop so as to execute commands TRT and SCM, as previously described. This looping process will be repeated until either a positive result is detected or the flag code appears; in the latter case (the signal from comparator 50 being $= d$), the sequence turns to a series of commands allowing the apparatus to analyze the jump to be commanded in such manner that the printing device of the printer is brought up to the first level of the channel under consideration in the next sheet.

The series of commands comprises a first part, which causes the progression of selection register 31 to position (SH). As is known, when at this position, the selection register will allow processing of the contents of register RH expressing sheet height in the form of the number of spaces. The two ensuing commands, SCT and ARH, allow the apparatus to analyze the number of spaces between the level of sheet 1 where the printer has stopped and the first stopping level of the channel under consideration, though in the next sheet 2 The first order SCT conditions coincident gate 53 so as to cause the subtraction of (RT)-(CI) in comparator 45, (RT) being the contents of register 43 storing the number of spaces of the first stopping level; the second command ARH conditions coincident gate 54 so as to cause addition (in lieu of subtraction) in adder 55 of the number of spaces (CH) corresponding to the height of a sheet and datum (RS) from register 46. The result from addition (RAT) is transmitted via register 56 and coincidence gate 57 to the printer 21. These commands activate:

1. again comparator enabling command SCT;
2. adder enabling command ARH; and
3. the transfer gate enabling command TRA.

As previously noted, the sequence will terminate upon a command that register 31 be reset to zero.

It is obvious that the above was described solely for illustrative purposes of a non-restricting nature and that all kinds of variations relating notably to the analyzing circuitry associated with memory 25 may be considered without thereby leaving the scope of the invention.

What is claimed is:

1. A process for determining the magnitude of the paper advance commanded in a printer, notably a printer associated with a data processing unit, the printing support being constituted by a series of sheets, each bounded by a top and bottom edge, and having equal heights, comprising the steps of:

a. determining at least one position, expressed by a whole number of spaces and with regard to the top edge of a first sheet, for a stopping level assigned to a particular kind of data that may be printed, and for the printing line at which the printer has stopped;

b. comparing, with regard to the top edge of the first sheet, the difference between said stopping level and the position of the printing line at which the printer has stopped;

c. commanding a jump which corresponds to the difference, expressed by a whole number of spaces, between the position of the stopping level and the position of the line at which the printer has stopped when the comparison discloses a stopping level farther from the top edge than the printing line at which the printer has stopped; and d. commanding a jump to the sheet following said first sheet which jump corresponds to the difference, expressed by a whole number of spaces, between the positions of the first stopping level added to the number of spaces in the height of a sheet and the position of the line at which the printer has stopped.

2. In a computer system which includes a data processing unit and a printer, said printer being used to print at least one type of data on a given area of a printing support, said printing support including a series of sheets, each sheet being of equal height and bounded by a top and bottom edge, between which edges are situated a plurality of stopping levels, at least one for each type of data to be printed, said stopping levels separating adjacent given areas and designating the number of spaces from the top of a page to the end of a given area on said sheet, said printer including a paper advance mechanism for advancing said printing support, and a pulse generator for emitting a first pulsed signal at each advance of said printing support by one space, and a second pulsed signal at each commencement of a new sheet of said printing support; an apparatus for determining the magnitude of the paper advance to be commanded in the printer, comprising in combination:

a storage unit connected to said data processing unit so as to receive control commands and control information therefor, and having a plurality of registers, arranged in a given sequence and including at least a first register for holding the type of data to be printed and a further register delineating a stopping level;

selection means, connected to said data processing unit and responsive to control commands therefrom so as to select, in said given sequence, each of said plurality of registers, and to permit the sequential storage of control information in, and the sequential removal of control information from, each of said plurality of registers; and a jump analysis circuit connected to said storage unit, said data processing unit and said printer, and including counter means connected to said pulse generator and responsive to said first and second pulsed signals so as to maintain at all times a count which indicates the current printing line, comparison means connected to said data processing unit, said counter means and said storage unit so as, on receipt of a first command signal from said data processing unit, to receive from said storage unit the contents of said further register as selected by said selector means, and to compare the position of the current printing line, as indicated by said counter means, and said stopping level, as indicated by the contents of said further register, and coincidence means connected to said data processing unit and said paper advance mechanism so as, on receipt of a command signal from said data processing unit, to actuate said paper advance mechanism to advance said printing support by a number of spaces equal to the difference indicated by said comparator.

3. Apparatus as defined in claim 2, wherein said jump analysis circuit includes a testing circuit connected to said data processing unit and to the output of said comparator means so as, on receipt of a second command signal from said data processing unit, to test the difference indicated by said comparision means, and to cause said data processing unit to issue a command signal for the printer when said current printing line falls between the top edge of the sheet and said stopping level, and a a command signal for a jump to a level of the next sheet when said current printing line falls below said stopping level.

4. Apparatus as defined in claim 3, wherein said testing circuit, when the data processing unit issues a command signal for a jump to a level of the next sheet, includes an adder whose inputs are connected to said storage unit and said subtractor means for receiving the contents of said further register and the number of spaces in the height of the sheet.

5. In a computer system which includes a data processing unit and a printer, said printer being used to print at least one type of data on a given area of a printing support, said printing support including a series of sheets, each sheet being of equal height and bounded by a top and bottom edge, between which edges are situated a plurality of stopping levels, at least one for each type of data to be printed, said stopping levels separating adjacent given areas and designating the number of spaces from the top of a page to the end of a given area on said sheet, said printer including a paper advance mechanism for advancing said printing support, and a pulse generator for emitting a first pulsed signal at each advance of said printing support by one space, and a second pulsed signal at each commencement of a new sheet of said printing support; an apparatus for determining the magnitude of the paper advance to be commanded in the printer, comprising in combination:

a storage unit connected to said data processing unit so as to receive control commands and control information therefrom, and having a plurality of registers, arranged in a given sequence and including groups of registers for holding said control information, one group for each type of data to be printed, each group including a first register for holding the type of data to be printed, and at least one further register, one for each stopping level, for holding said stopping levels sequentially in order of occurrence from the top of a sheet to the bottom of a sheet, said storage unit also including selection means, connected to said data processing unit and responsive to control commands therefrom so as to select, in said given sequence, each of said plurality of registers, and to permit the sequential storage of control information in, and the sequential removal of control information from, each of said plurality of registers; and a jump analysis circuit connected to said storage unit, said data processing unit and said printer, and including counter means connected to said pulse generator and responsive to said first and second pulsed signals so as to maintain at all times a count which indicates the current printing line, comparison means connected to said data processing unit, said counter means and said storage unit so as, on receipt of a first command signal from said data processing unit, to receive from said storage unit the contents of a selected one of said further registers, as selected by said selection means, and to compare the position of the current printing line, as indicated by said counter means, and said stopping level for a given type of data, as indicated by the contents of said selected one of said further registers, testing circuit included in the jump analysis circuit and connected to said data processing unit to the output of said comparison means so as, on receipt of a second command signal from said data processing unit, to test the difference indicated by the comparison means, and to cause said data processing unit to issue a third command signal when said current printing line falls between the top edge of the sheet and said stopping level, and a fourth command signal when said current printing line falls below said stopping level, and coincidence means connected to said data processing unit, and said paper advance mechanism so as, on receipt of said third command signal from said data processing unit to actuate said paper advance mechanism to advance said printing support by a number of spaces equal to the difference indicated by said subtractor means.

6. An apparatus as recited in claim 5 wherein said storage unit also includes further means connected to said data processing unit and said selector means for detecting, on receipt of a further command signal from said data processing unit, the end of said given sequence of register selection, and for acting on said selector means so as to allow reinitiation of said given sequence.

7. An apparatus as recited in claim 5 wherein said storage unit includes a register for holding the height of a sheet and said jump analysis circuit includes adder means connected to said data processing unit, said comparison means, said storage unit and said paper advance mechanism so as, on receipt of said fifth command signal, to compute a result equal to the number of spaces necessary to advance the printing support to the first space on the subsequent sheet of the given area corresponding to the given type of data, and means for transmitting said result to said paper advance mechanism so as to actuate the latter to advance said printing support by said number of spaces.

* * * * *